US009193360B2

(12) United States Patent
Duer

(10) Patent No.: US 9,193,360 B2
(45) Date of Patent: Nov. 24, 2015

(54) STATION FOR A CABLE RAILWAY SYSTEM

(71) Applicant: INNOVA PATENT GMBH, Wolfurt (AT)

(72) Inventor: Gerd Duer, Bildstein (AT)

(73) Assignee: INNOVA PATENT GMBH, Wolfurt (AT)

( * ) Notice: Subject to any disclaimer, the term of this patent is extended or adjusted under 35 U.S.C. 154(b) by 16 days.

(21) Appl. No.: 13/966,918

(22) Filed: Aug. 14, 2013

(65) Prior Publication Data

US 2014/0069292 A1 Mar. 13, 2014

(30) Foreign Application Priority Data

Sep. 13, 2012 (AT) ..... A 1000/2012

(51) Int. Cl.

| | |
|---|---|
| ***B61B 9/00*** | (2006.01) |
| ***B61B 1/02*** | (2006.01) |
| ***B61B 12/02*** | (2006.01) |
| ***B61B 11/00*** | (2006.01) |

(52) U.S. Cl.

CPC ..... *B61B 12/024* (2013.01); *B61B 11/00* (2013.01); *B61B 12/022* (2013.01)

(58) Field of Classification Search

CPC ..... B61B 7/00; B61B 7/02; B61B 7/04; B61B 7/045; B61B 9/00; B61B 10/00; B61B 10/001; B61B 10/02; B61B 10/025; B61B 10/027; B61B 11/00; B61B 11/004; B61B 12/10; B61B 12/12; B61B 12/122

USPC ..... 104/165, 173.1–175, 196–202

See application file for complete search history.

(56) References Cited

U.S. PATENT DOCUMENTS

| | | | | |
|---|---|---|---|---|
| 4,942,823 | A * | 7/1990 | Meindl | 104/178 |
| 7,685,947 | B2 * | 3/2010 | Moritzhuber | 104/180 |
| 8,359,980 | B2 | 1/2013 | Beck | |
| 2007/0227394 | A1 * | 10/2007 | Mugnier | 104/180 |
| 2012/0042803 | A1 * | 2/2012 | Beck | 104/112 |

FOREIGN PATENT DOCUMENTS

| | | | |
|---|---|---|---|
| EP | 2441638 | A1 | 4/2012 |

* cited by examiner

*Primary Examiner* — R. J. McCarry, Jr.

(74) *Attorney, Agent, or Firm* — Laurence Greenberg; Werner Stemer; Ralph Locher

(57) ABSTRACT

A cable railway installation has an endless conveying cable extending between terminal stations. Transport vehicles, such as chairs or gondolas, are coupleable to the conveying cable. In the two terminal stations the cable is guided over headwheels and, in optionally provided intermediate stations, it is guided over diverting pulleys, diverting rollers or the like. The transport vehicles entering the terminal stations are uncoupled from the conveying cable, conveyed through the stations by guide tires and then coupled to the conveying cable for exiting the stations. A load bearing structure, which carries components such as the headwheels, diverting pulleys and rollers, and the guide tires, is borne by at least one support disposed centrally between the paths of motion of the transport vehicles. An ascent leads up to the load bearing structure. The support carrying the load bearing structure is formed with a through passage through which the ascent is routed.

10 Claims, 6 Drawing Sheets

STATION FOR A CABLE RAILWAY SYSTEM

CROSS-REFERENCE TO RELATED APPLICATION

This application claims the priority, under 35 U.S.C. §119 (a), of Austrian patent application AT 1000/2012, filed Sep. 13, 2012; the prior application is herewith incorporated by reference in its entirety.

BACKGROUND OF THE INVENTION

Field of the Invention

The invention lies in the field of cableway systems, also referred to as ropeway installations and cable railroad installations. More specifically, the subject matter of the invention relates to a station for a cableway installation having a conveying cable and transport vehicles, such as gondolas and chairs (i.e., multi-person lift chairs), which are coupleable to the rope. The conveying cable in the two terminal stations is in each case guided about a deflecting pulley, or headwheel, and, in an optionally provided intermediate station, being guided over diverting pulleys, diverting rollers or similar. When the transport vehicles enter the terminal stations they are uncoupled from the conveying cable and conveyed through said stations by way of guide tires, and when the transport vehicles exit the terminal stations they are coupled to the conveying cable. A load bearing structure is located in each station for the deflecting pulleys, the diverting pulleys, diverting rollers or similar and the guide tires, said load bearing structure being borne by at least one support which is located between the paths of motion of the transport vehicles and which is embodied with an ascent running at least approximately in the direction of motion of the transport vehicles, said ascent being accessible for the installation, the inspection, the maintenance, the repair and similar of the components of the installation located on the support.

Such cableway installations, which are described, for example, in commonly assigned U.S. Pat. No. 8,359,980 B2 and its counterpart European published patent application EP 2441638 A1, have a valley station and a mountain station, and optionally an intermediate station which is located between these two terminal stations. A conveying cable, which is in the form of a closed loop, extends along the entire course of this cableway installation, said conveying cable in the two terminal stations being guided over deflecting pulleys, of which at least one of these two deflecting pulleys, usually the one located in the mountain station, is driven. In the intermediate station, which may be optionally provided if need be, the conveying cable is guided over diverting pulleys, diverting rollers and similar.

Furthermore, transport vehicles, such as gondolas or chairs, which are coupled to the conveying cable along the line, are to be found in such cableway installations, the transport vehicles being uncoupled from the conveying cable in the stations, conveyed through the stations by means of guide tires and then coupled again to the conveying cable.

Upon entry into a station, the transport vehicles are uncoupled from the conveying cable and conveyed through the station along guide rails. After uncoupling from the conveying cable, the speed of the transport vehicles is reduced by means of deceleration tires, following which the transport vehicles are conveyed by guide tires at a speed of approximately 0.3 m/sec through the passenger boarding or disembarking region, respectively, where passengers get on or get off, respectively. Thereafter, the speed of the transport vehicles is accelerated by way of acceleration tires to the speed at which the conveying cable is driven, namely approximately 7 m/sec. Then the transport vehicles are once more coupled to the conveying cable.

In the stations, load bearing structures are provided above the motion paths of the transport vehicles, or above the boarding or alighting regions for the passengers, for the deflecting pulleys which are located in the stations, and for the guide tires which are located in the stations for the transport vehicles, namely the deceleration tires, the conveyor tires and the acceleration tires, and furthermore for the drives of the guide tires and for the diverting pulleys, diverting rollers and similar which are located in optional intermediate stations. At least one of the two deflecting pulleys is mounted on the corresponding load bearing structure in a sliding manner in the longitudinal direction of the cableway installation, in order to generate the necessary tension of the conveying cable or, to offset the elongation of the conveying cable.

The load bearing structure is borne by at least one support, which is located in the station and within the path of motion of the transport vehicles. In order to be able to carry out installation, inspection, maintenance, repair and similar work on the components located on the load bearing structure, an ascent must further be provided through which the load bearing structure is accessible. This ascent opens onto the load bearing structure between the deflecting roller and the entry and/or exit end of the load bearing structure. Since the entering transport vehicles still have a high speed and, conversely, the exiting transport vehicles already have a high speed in this region of the cableway installation, the ascent has to be located at a sufficient distance from the motion path of the transport vehicles. For this reason, it is not possible to arrange the ascent on the side of the support of the load bearing structure, said support also being located in this region.

The required distance of the ascent from the motion path of the transport vehicles is maintained when the ascent, together with the support positioned there for the load bearing structure, is located in the direction of the exiting transport vehicles adjacent to the support in the longitudinal direction of the cableway installation within the motion path of the transport vehicles. However, this makes available only a short length for the ascent leading onto the load bearing structure, such that said ascent has a very great steepness. It has to be considered in this context that very heavy equipment, which has to be carried by the technicians up the ascent onto the load bearing structure, is often necessary for the type of work which is required on the load bearing structure, which is why the steepness of the ascent should not exceed an angle of approximately 50°.

Even then, however, there is the difficulty in that the distance between the transport vehicles approaching the boarding or alighting region or departing the boarding or alighting region and the support, which is located in this region, is so small that technicians moving towards the ascent or coming from the ascent are endangered in the regions beside the support by the transport vehicles moving past the latter.

SUMMARY OF THE INVENTION

It is accordingly an object of the invention to provide a station for a cableway railroad which overcomes the above-mentioned disadvantages of the heretofore-known devices and methods of this general type and which provides for an ascent onto the load bearing structure which meets the requirements of adequate steepness and of sufficient distance from the motion path of the transport vehicles.

With the foregoing and other objects in view there is provided, in accordance with the invention, a station for a cable railway system. The cable railway system has a conveying cable and transport vehicles that are coupleable to the conveying cable, the conveying cable extending between two terminal stations where the conveying cable is guided over respective deflecting pulleys, and wherein the transport vehicles, upon entering a terminal station at an entry side thereof, are decoupled from the conveying cable and conveyed through the station by way of guide tires, and the transport vehicles are coupled to the conveying cable for exiting the terminal station at an exit side thereof. The invention is a station for the cable railway system that comprises:

- a load bearing structure carrying the cable deflecting pulleys and the guide tires;
- at least one support carrying said load bearing structure, said at least one support being located between the paths of motion of the transport vehicles in the station;
- an ascent running substantially in a direction of motion of the transport vehicles and providing personnel access to components located on said support; and
- said support facing an entry and/or exit end of said load bearing structure having a through passage formed therein through which said ascent is routed.

In other words, the objects of the invention are achieved according to the invention in that the support, or the support facing the entry and/or exit end of the load bearing structure, is embodied with a passage through which the ascent is routed.

The support is preferably embodied as a one-piece support column which is embodied with the passage through which the ascent is routed. The support may be formed by a support column having a cross section which is tapered from bottom to top or, a cross section which widens from bottom to top and is embodied with the passage through which the ascent is routed.

The support may further be formed by two support columns which are located at a distance beside one another transversely to the direction of motion of the transport vehicles, thus forming the passage through which the ascent is routed. Moreover, the support may be formed by two support columns which together create an acute angle. Finally, the passage may be located at a central height level of the support, the ascent continuing onto a bridge on the side of the passage which is facing away from said ascent.

Other features which are considered as characteristic for the invention are set forth in the appended claims.

Although the invention is illustrated and described herein as embodied in a station for a cableway installation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
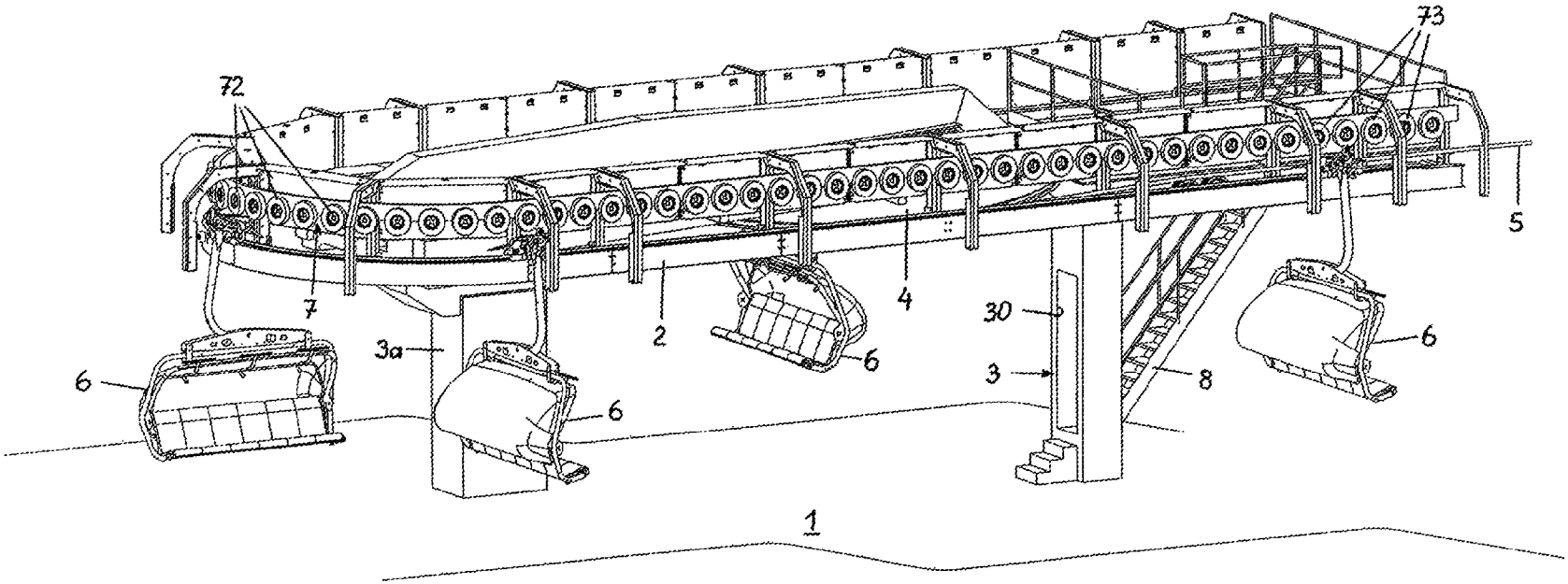
FIG. 1 is a perspective view of a first embodiment of a cableway station according to the invention.
Figure 3:
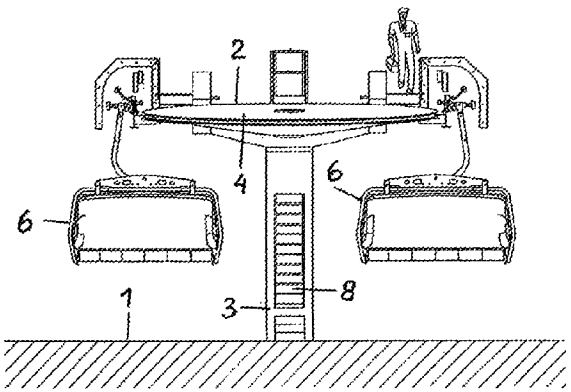
FIG. 3 is a front elevation view of the cableway station according to FIG. 1.

Referring now to the figures of the drawing in detail and first, particularly, to FIGS. 1 to 4 thereof, there is shown a terminal station of a cableway system. The station has a load bearing structure 2 which is located above the floor 1 of the cableway station, said load bearing structure 2 being borne by two column-shaped supports 3 and 3*a*. A cable deflecting pulley 4, also referred to as a headwheel 4, is mounted on the load bearing structure 2. A conveying cable 5, also referred to as a haulage rope or haul cable, is guided around the deflection pulley 4. Transport vehicles or cars 6, such as chairs or gondolas, are coupleable to the conveying cable 5. Furthermore, guide tires 7, namely deceleration tires 71, conveyor tires 72 and acceleration tires 73, are located on the load bearing structure 2, by means of which tires the transport vehicles 6, after having been uncoupled upon entry into the station from the conveying cable 5, are conveyed through the station along guide rails.

Figure 2:
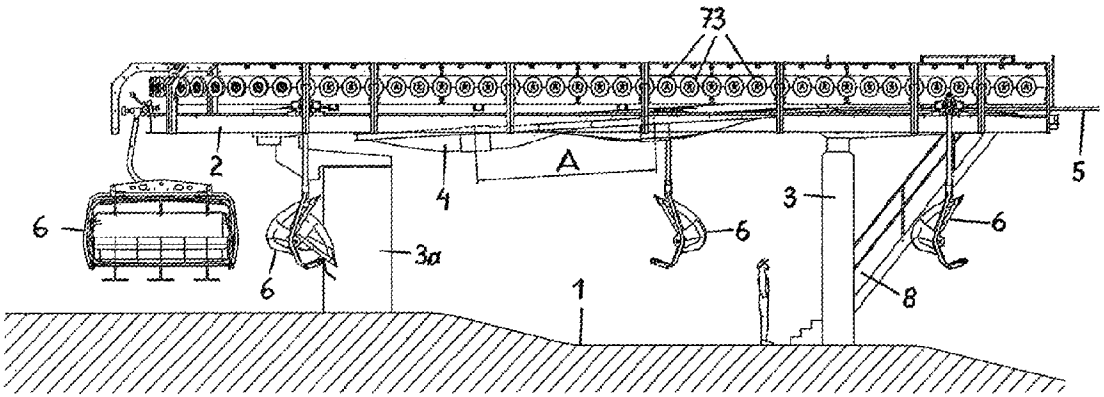
FIG. 2 is a side elevation view of the cableway station according to FIG. 1.
Figure 4:
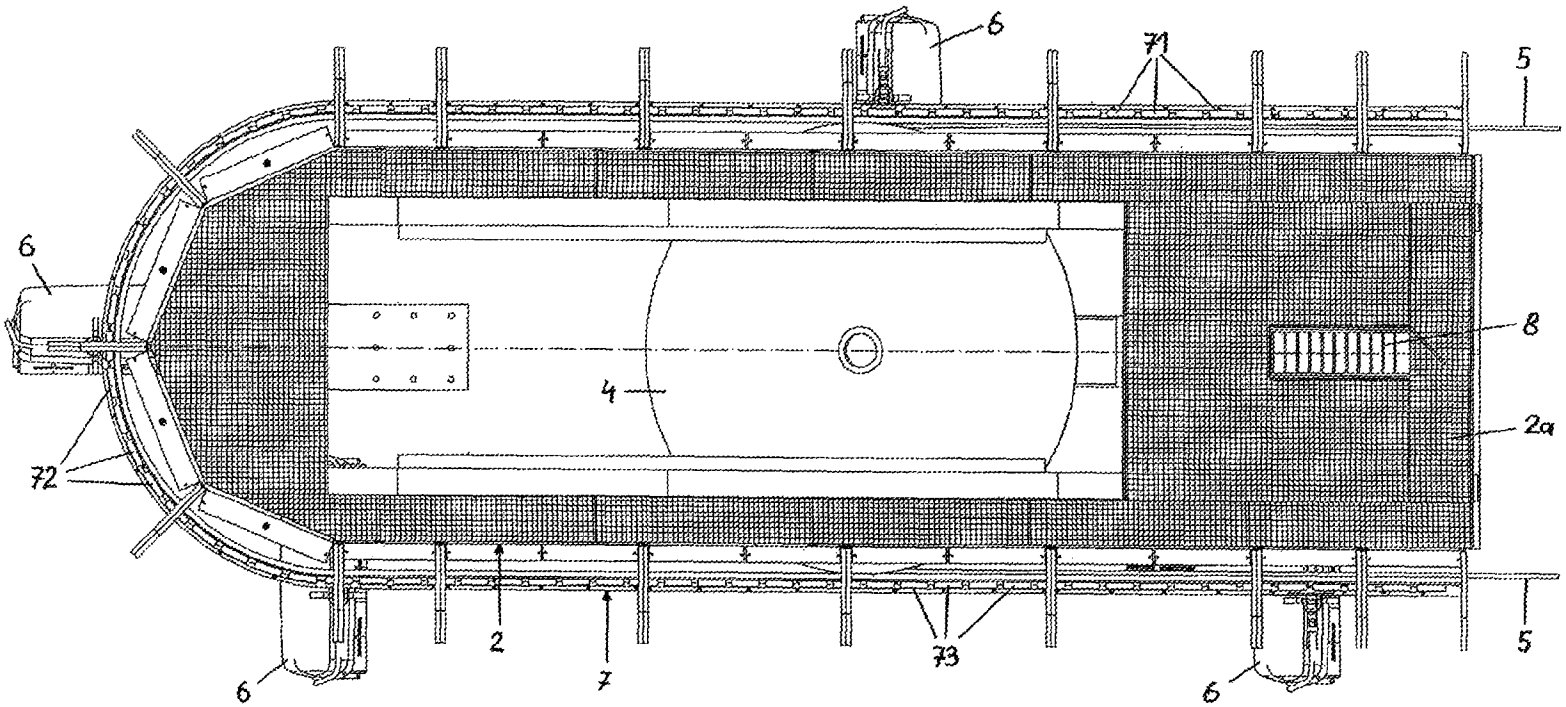
FIG. 4 is a plan view onto the cableway station according to FIG. 1.

The cable deflecting pulley 4 is mounted slideably in the longitudinal direction of the cableway installation on the load bearing structure 2, as is indicated by a line A in FIG. 2, in order to generate the necessary tension of the conveying cable 5.

In order to be able to carry out installation, inspection, maintenance and repair on the components, namely the cable deflecting pulley 4, the guide tires 7, the drives for the guide tires 7 and similar, which are located on the load bearing structure 2, an ascent 8, for example in the form of a stairway, is provided which leads from the floor 1 to the work area 2*a* of the load bearing structure 2, said ascent 8 opening onto the entry or exit region of the load bearing structure 2. For this ascent 8, the support 3 is embodied with a passage 30, through which the ascent 8 is routed.

This achieves the result that the ascent 8 is also located in the central region between the motion path of the transport vehicles 6 and that said ascent has a steepness that enables the technicians to transport even heavy work equipment.

Figure 5:
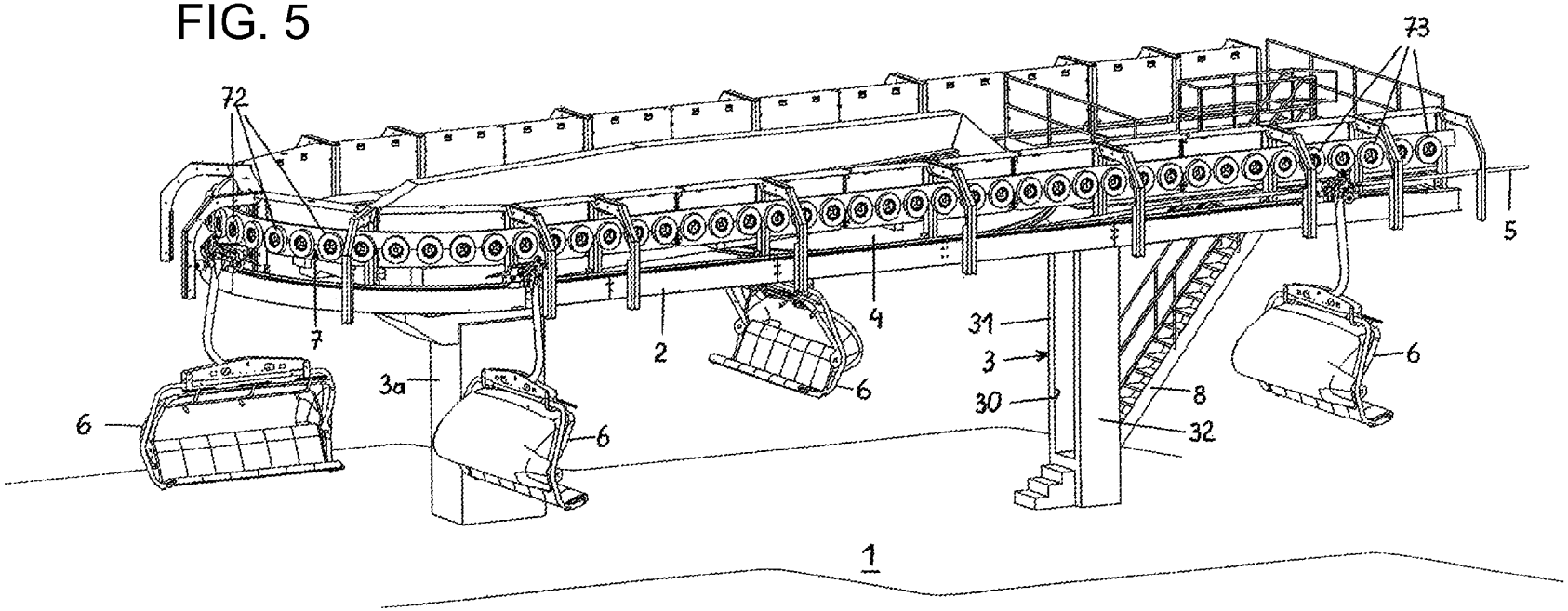
FIG. 5 is a perspective view of a second embodiment of a cableway station according to the invention.

The second embodiment illustrated in FIG. 5 differs from the first embodiment in that the support 3 is formed by two support columns 31 and 32 which are at a distance from one another, the ascent 8 being routed between them.

Figure 6:
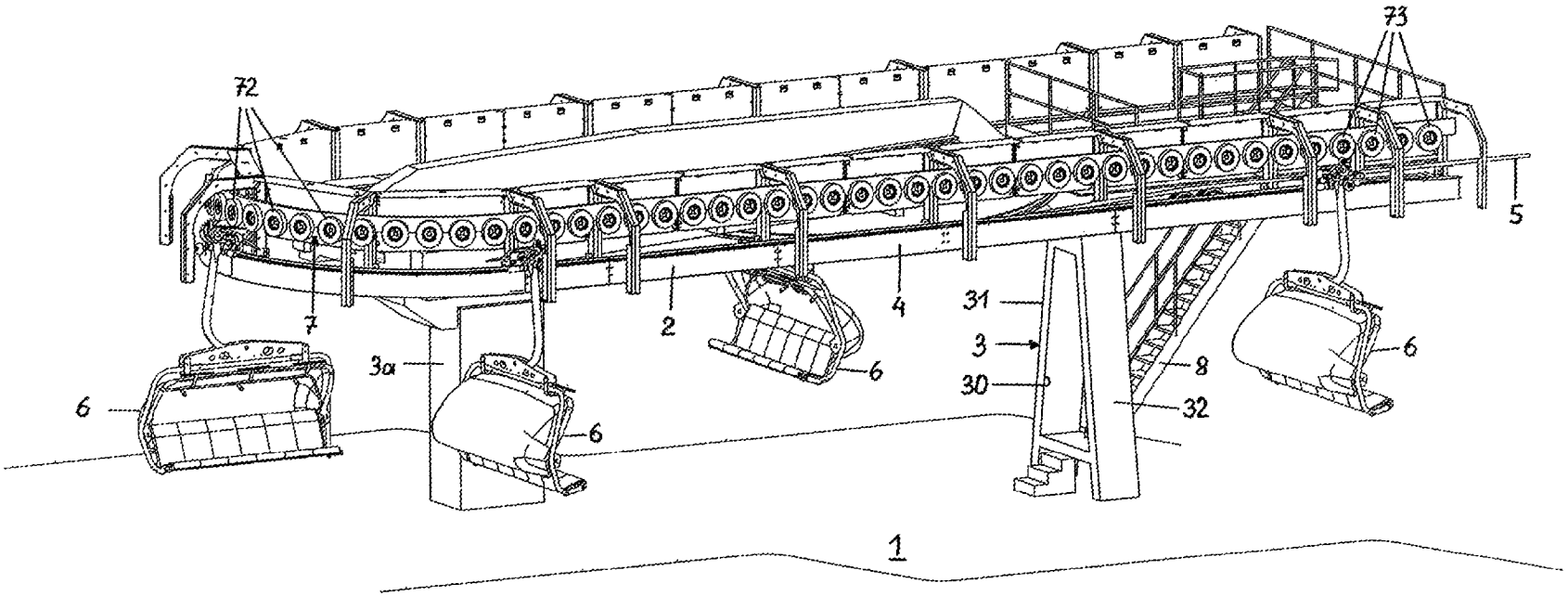
FIG. 6 is a perspective view of a third embodiment of a cableway station according to the invention.

The third embodiment illustrated in FIG. 6 differs from the second embodiment in that the two support columns 31 and 32 form an acute angle, this embodying the entire support in an A-shaped elevation, causing an enlarged support of the load bearing structure 2 in the transverse direction of the cableway installation.

Figure 7:
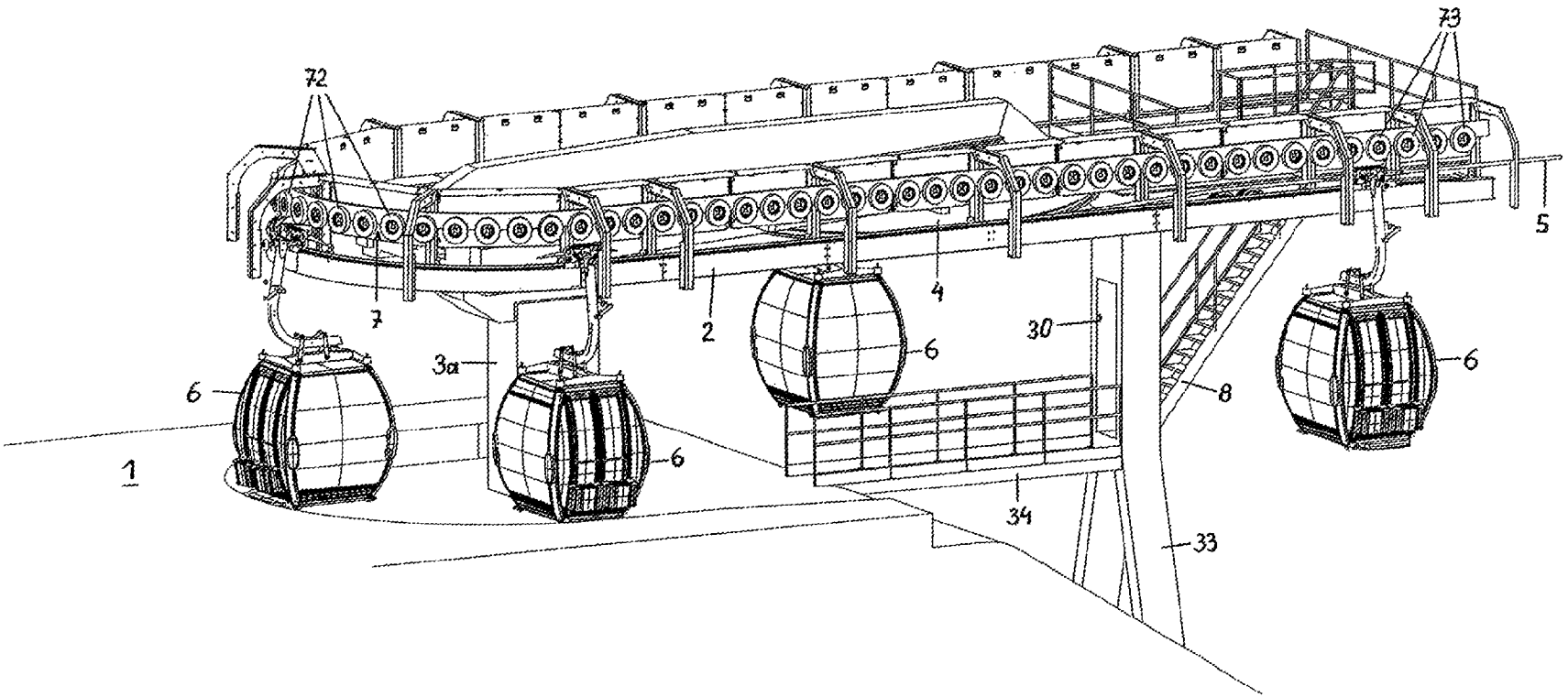
FIG. 7 is a perspective view of a fourth embodiment of a cableway station according to the invention.

The fourth embodiment illustrated in FIG. 7 differs from the other embodiments in that the support 33 is anchored below the floor area 1, on which the boarding and alighting region, respectively, for passengers is located, such that the passage 30 is located at a central height level of the support 33, and that a bridge 34 is provided from the floor area 1 to the passage, the ascent 8 continuing onto said bridge.

The invention claimed is:

1. In a cable railway system having a conveying cable and transport vehicles that are coupleable to the conveying cable, the conveying cable extending longitudinally between two terminal stations where the conveying cable is guided over respective deflecting pulleys, and wherein the transport vehicles, upon entering a terminal station at an entry side thereof, are decoupled from the conveying cable and conveyed through the station by way of guide tires, and the transport vehicles are coupled to the conveying cable for exiting the terminal station at an exit side thereof, a station for the cable railway system, the station comprising:

a load bearing structure carrying the cable deflecting pulleys and the guide tires;

at least one support carrying said load bearing structure, said at least one support being located between the paths of motion of the transport vehicles in the station;

an ascent running in a longitudinal direction of motion of said conveying cable between said two terminal stations and providing personnel access to components including the deflecting pulleys and the guide tires located on said support; and said support facing an entry and/or exit end of said load bearing structure having a through passage formed therein through which said ascent is routed.

2. The station according to claim 1, wherein the station is an intermediate station disposed between the terminal stations and the conveying cable is guided over diverting pulleys or diverting rollers in the intermediate station.

3. The station according to claim 1, wherein the load bearing structure carries components selected from the group consisting of cable deflecting pulleys, diverting pulleys, diverting rollers, and guide tires.

4. The station according to claim 1, wherein said through passage is configured for personnel access for maintenance, installation, inspection, or repair of the components carried on said support.

5. The station according to claim 1, wherein said support is a one-piece support column formed with said through passage and said through passage is aligned with said ascent.

6. The station according to claim 1, wherein said support is a support column having a cross section that is tapered from bottom to top and being formed with said through passage through which said ascent is routed.

7. The station according to claim 1, wherein said support is a support column having a cross section that widens from bottom to top and being formed with said through passage through which said ascent is routed.

8. The station according to claim 1, wherein said support has two support columns disposed beside one another transversely to the direction of motion of the transport vehicles and with a spacing distance there between forming said through passage through which said ascent is routed.

9. The station according to claim 1, wherein said support has two support columns together enclosing an acute angle.

10. The station according to claim 1, wherein said through passage is formed at a central height level of said support and said ascent continues onto a bridge on a side of said passage through said support facing away from said ascent.

* * * * *